US010643542B2

(12) United States Patent
Li

(10) Patent No.: US 10,643,542 B2
(45) Date of Patent: May 5, 2020

(54) PIXEL DRIVING CIRCUIT AND DISPLAY DEVICE WITH THE SAME

(71) Applicant: Wuhan China Star Optoelectronics Semiconductor Display Technology Co., Ltd., Wuhan (CN)

(72) Inventor: Jun Li, Shenzhen (CN)

(73) Assignee: WUHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 0 days.

(21) Appl. No.: 16/111,214

(22) Filed: Aug. 24, 2018

(65) Prior Publication Data

US 2019/0304371 A1 Oct. 3, 2019

Related U.S. Application Data

(63) Continuation of application No. PCT/CN2018/087737, filed on May 22, 2018.

(30) Foreign Application Priority Data

Mar. 30, 2018 (CN) ..... 2018 1 0297372

(51) Int. Cl.
*G09G 3/3258* (2016.01)

(52) U.S. Cl.
CPC ..... *G09G 3/3258* (2013.01); *G09G 2300/043* (2013.01); *G09G 2300/0426* (2013.01);
(Continued)

(58) Field of Classification Search
CPC ..... G09G 3/3258; G09G 2320/0626; G09G 2320/0238; G09G 2320/066;
(Continued)

(56) References Cited

U.S. PATENT DOCUMENTS

2004/0246242 A1* 12/2004 Sasaki ..... G09G 3/342 345/204
2012/0147060 A1* 6/2012 Jeong ..... G09G 3/3233 345/690
(Continued)

FOREIGN PATENT DOCUMENTS

CN 105679249 A 6/2016
CN 106991964 A 7/2017
(Continued)

*Primary Examiner* — Brent D Castiaux

(57) ABSTRACT

The present disclosure relates to a pixel driving circuit and a display device. The circuit includes a first reset circuit, a second reset circuit, a compensation circuit, and a light emitting circuit. The first reset circuit is configured to transmit a first reset voltage to the compensation circuit to reset the compensation circuit. The second reset circuit is configured to transmit a second reset voltage to the light emitting circuit to reset the light emitting circuit. The compensation circuit is configured to write a data signal and perform a threshold voltage compensation. The light emitting circuit is configured to emit light. Through the above-mentioned manner, the present disclosure may be capable of realizing the compensation of the threshold voltage and adjusting the contrast of the displayed black screen, thereby improving the display characteristics of the display device.

20 Claims, 3 Drawing Sheets

(52) U.S. Cl.
CPC ..... *G09G 2300/0819* (2013.01); *G09G 2320/0238* (2013.01); *G09G 2320/066* (2013.01); *G09G 2320/0626* (2013.01)

(58) Field of Classification Search
CPC ... G09G 2300/0426; G09G 2300/0819; G09G 2300/043; G09G 3/3233; G09G 2300/0842; G09G 2300/0861; G09G 2310/0251; G09G 2310/0262; G09G 2320/0233; G09G 2320/045
See application file for complete search history.

(56) References Cited

U.S. PATENT DOCUMENTS

| | | | | |
|---|---|---|---|---|
| 2017/0069264 | A1 | 3/2017 | Dai et al. | |
| 2018/0130420 | A1* | 5/2018 | Gao ..... | G09G 3/3233 |

FOREIGN PATENT DOCUMENTS

| | | | | |
|---|---|---|---|---|
| CN | 107180612 | A | | 9/2017 |
| CN | 107610640 | A | * | 1/2018 |
| CN | 107610640 | A | | 1/2018 |
| KR | 20100047505 | A | | 5/2010 |

* cited by examiner

PIXEL DRIVING CIRCUIT AND DISPLAY DEVICE WITH THE SAME

CROSS-REFERENCE TO RELATED APPLICATIONS

The present application is a continuation-application of International (PCT) Patent Application No. PCT/CN2018/087737 filed on May 22, 2018, which claims foreign priority of Chinese Patent Application No. 201810297372.3, filed on Mar. 30, 2018 in the State Intellectual Property Office of China, the entire contents of which are hereby incorporated by reference.

TECHNICAL FIELD

Embodiments of the present disclosure generally relate to liquid crystal display technology, and in particular relate to a pixel driving circuit and a display device with the pixel driving circuit.

BACKGROUND

Organic light-emitting diodes (OLEDs) have the characteristics of wide color gamut, high contrast, energy saving, and fold-ability, and thus have a strong competitiveness in new generation's displays. Among them, active-matrix organic light-emitting diode (AMOLED) technology is one of the key development directions for flexible displays. The basic driving circuit of AMOLED is shown in FIG. 1, which belongs to the 2T1C mode including two thin film transistors and one storage capacitor. Specifically, it includes a switching thin film transistor A1, a driving thin film transistor A2, and a storage capacitor C1. The driving current of OLED is controlled by the driving thin film transistor A2, and has the current size of $I_{OLED}=k(V_{gs}-V_{th})^2$, where k is a current amplification factor of the driving thin film transistor A2, which is determined by the characteristic of the driving thin film transistor A2 itself, and Vth is a threshold voltage of the driving thin film transistor A2. The threshold voltage Vth of the driving thin film transistor A2 may shift due to long operation time, which results in the change in the driving current of OLED, and may cause defects in OLED panel and affect the image quality.

SUMMARY

The technical problem mainly solved by the present disclosure is to provide a pixel driving circuit and a display device which may be capable of realizing the compensation of the threshold voltage while adjusting the contrast of the displayed black screen, thereby improving the display characteristics of the display device.

To solve the above-mentioned technical problems, a technical solution adopted by the present disclosure is to provide a pixel driving circuit. The circuit may include a first reset circuit, a second reset circuit, a compensation circuit, and a light emitting circuit; the first reset circuit may be configured to receive a first control signal and transmit a first reset voltage to the compensation circuit to reset the compensation circuit according to the first control signal; the second reset circuit may be configured to receive a second control signal and transmit a second reset voltage to the light emitting circuit to reset the light emitting circuit according to the second control signal; the compensation circuit may be configured to receive the second control signal and write a data signal and perform a threshold voltage compensation according to the second control signal; the light emitting circuit may be configured to receive a third control signal and emit light according to the third control signal; where, the first reset circuit may include a fourth thin film transistor; a gate electrode of the fourth thin film transistor may receive the first control signal, a source electrode of the fourth thin film transistor may be connected to the first reset voltage, and a drain electrode of the fourth thin film transistor may be connected to the compensation circuit; where, the second reset circuit may include a seventh thin film transistor; a gate electrode of the seventh thin film transistor may receive the second control signal, a source electrode of the seventh thin film transistor may be connected to the second reset voltage, and a drain electrode of the seventh thin film transistor may be connected to the light emitting circuit; where, the compensation circuit may include a first thin film transistor, a second thin film transistor, a third thin film transistor, and a storage capacitor; a gate electrode of the first thin film transistor may be connected to each of one end of the storage capacitor, a drain electrode of the second thin film transistor, and the first reset circuit; a drain electrode of the first thin film transistor may be connected to each of the light emitting circuit and a source electrode of the second thin film transistor; a source electrode of the first thin film transistor may be connected to each of the light emitting circuit and a drain electrode of the third thin film transistor; each gate electrode of the second thin film transistor the third thin film transistor may receive the second control signal; a source electrode of the third thin film transistor may receive the data signal; and a other end of the storage capacitor may be connected to a first voltage; where, the light emitting circuit may include a fifth thin film transistor, a sixth thin film transistor, and a light emitting element; a gate electrode of the fifth thin film transistor may receive the third control signal, and a drain electrode of the fifth thin film transistor may be connected to the drain electrode of the first thin film transistor, a source electrode of the fifth thin film transistor may be connected to each of an anode electrode of the light emitting element and the drain electrode of the seventh thin film transistor; a gate electrode of the sixth thin film transistor may receive the third control signal, a drain electrode of the sixth thin film transistor may be connected to the first voltage, a source electrode of the sixth thin film transistor may be connected to the source electrode of the first thin film transistor; and a cathode electrode of the light emitting element may be connected to a second voltage; where, the first voltage may be a high level, and each of the second voltage, the first reset voltage, and the second reset voltage may be a low level; where, the working process of the circuit may be divided into a first working phase, a second working phase, and a third working phase; in the first working phase, the first control signal may be valid while the second control signal and the third control signal may be invalid; in the second working phase, the second control signal may be valid while the first control signal and the third control signal may be invalid; in the third working phase, the third control signal may be valid while the first control signal and the second control signal may be invalid.

In order to solve the above-mentioned technical problems, another technical solution adopted by the present disclosure is to provide a pixel driving circuit. The circuit may include a first reset circuit, a second reset circuit, a compensation circuit, and a light emitting circuit; the first reset circuit may be configured to receive a first control signal and transmit a first reset voltage to the compensation circuit to reset the compensation circuit according to the first control signal; the second reset circuit may be configured to receive a second control signal and transmit a second reset voltage to the light emitting circuit to reset the light emitting circuit according to the second control signal; the compensation circuit may be configured to receive the second control signal and write a data signal and perform a threshold voltage compensation according to the second control signal; and the light emitting circuit may be configured to receive a third control signal and emit light according to the third control signal.

In order to solve the above-mentioned technical problems, another technical solution adopted by the present disclosure is to provide a display device including a pixel driving circuit. The circuit may include a first reset circuit, a second reset circuit, a compensation circuit, and a light emitting circuit; the first reset circuit may be configured to receive a first control signal and transmit a first reset voltage to the compensation circuit to reset the compensation circuit according to the first control signal; the second reset circuit may be configured to receive a second control signal and transmit a second reset voltage to the light emitting circuit to reset the light emitting circuit according to the second control signal; the compensation circuit may be configured to receive the second control signal and write a data signal and perform a threshold voltage compensation according to the second control signal; and the light emitting circuit may be configured to receive a third control signal and emit light according to the third control signal.

The beneficial effects of the present disclosure may be as follows. The pixel driving circuit and the display device of the present disclosure may include a first reset circuit, a second reset circuit, a compensation circuit, and a light emitting circuit. The first reset circuit may be configured to receive a first control signal and transmit a first reset voltage to the compensation circuit to reset the compensation circuit according to the first control signal. The second reset circuit may be configured to receive a second control signal and transmit a second reset voltage to the light emitting circuit to reset the light emitting circuit according to the second control signal. The compensation circuit may be configured to receive the second control signal, and write a data signal and perform a threshold voltage compensation according to the second control signal. The light emitting circuit may be configured to receive a third control signal and emit light according to the third control signal. Through the above-mentioned manner, the present disclosure may be capable of realizing the compensation of the threshold voltage and adjusting the contrast of the displayed black screen by adjusting the first reset voltage and the second reset voltage, thereby improving the display characteristics of the display device.

BRIEF DESCRIPTION OF THE DRAWINGS

In order to more clearly illustrate the technical solution in the embodiments of the present disclosure, the accompanying drawings to be used in the description of the embodiments are briefly described below. It will be apparent that the accompanying drawings in the following description are merely embodiments of the present disclosure, and other accompanying drawings may be obtained without creative work for those skilled in the art.

DETAILED DESCRIPTION

The following will clearly and completely describe the technical solutions in the embodiments of the present disclosure with reference to the accompanying drawings in the embodiments of the present disclosure. It is to be understood that the specific embodiments described herein are only used to explain the present disclosure and are not intended to limit the present disclosure. It's obvious that only part but not all of the embodiments related to the present disclosure are provided. All other embodiments obtained based on the embodiments of the present disclosure by those skilled in the art without making creative efforts shall fall within the protection scope of the present disclosure.

Figure 1:
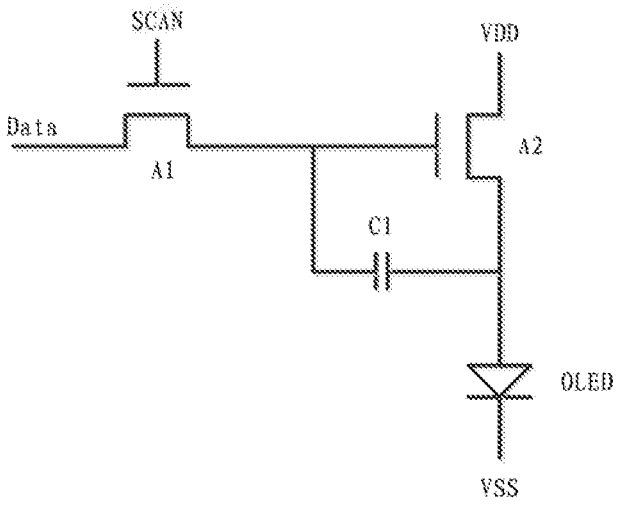
FIG. 1 (Prior art)
FIG. 1 is a circuit diagram of a pixel driving circuit in the prior art.
Figure 2:
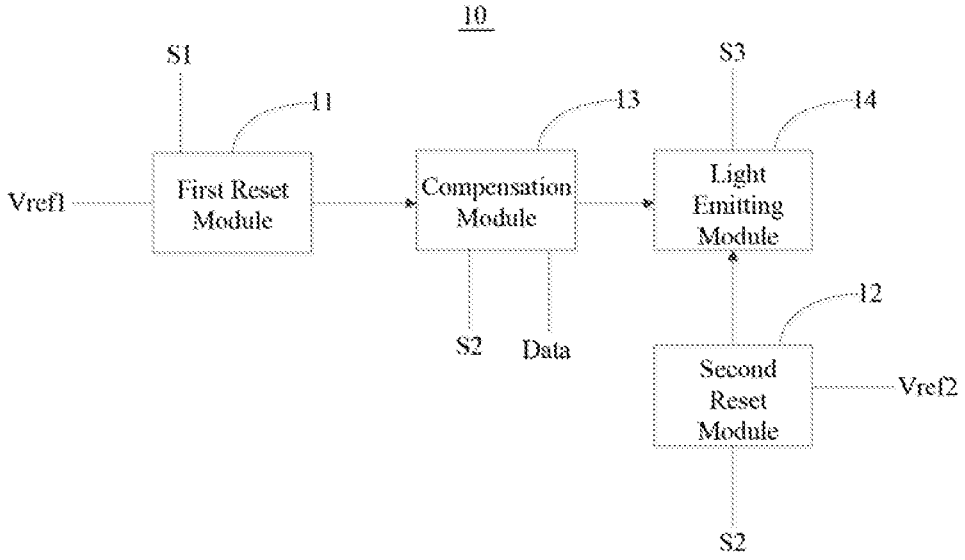
FIG. 2 is a schematic diagram of the structure of a pixel driving circuit according to an embodiment of the present disclosure.

Referring to FIG. 2, a schematic diagram of the structure of a pixel driving circuit according to an embodiment of the present disclosure is depicted. As shown in FIG. 2, the pixel driving circuit 10 may include a first reset circuit 11, a second reset circuit 12, a compensation circuit 13, and a light emitting circuit 14. In some embodiments, the compensation circuit 13 may be connected to each of the first reset circuit 11 and the light emitting circuit 14, and the second reset circuit 12 may be connected to the light emitting circuit 14.

The first reset circuit 11 may be configured to receive a first control signal S1 and transmit a first reset voltage Vref1 to the compensation circuit 13 to reset the compensation circuit 13 according to the first control signal S1.

The second reset circuit 12 may be configured to receive a second control signal S2 and transmit a second reset voltage Vref2 to the light emitting circuit 14 to reset the light emitting circuit 14 according to the second control signal S2.

The compensation circuit 13 may be configured to receive the second control signal S2, write a data signal Data, and perform a threshold voltage compensation according to the second control signal S2.

The light emitting circuit 14 may be configured to receive a third control signal S3 and emit light according to the third control signal S3.

Figure 3:
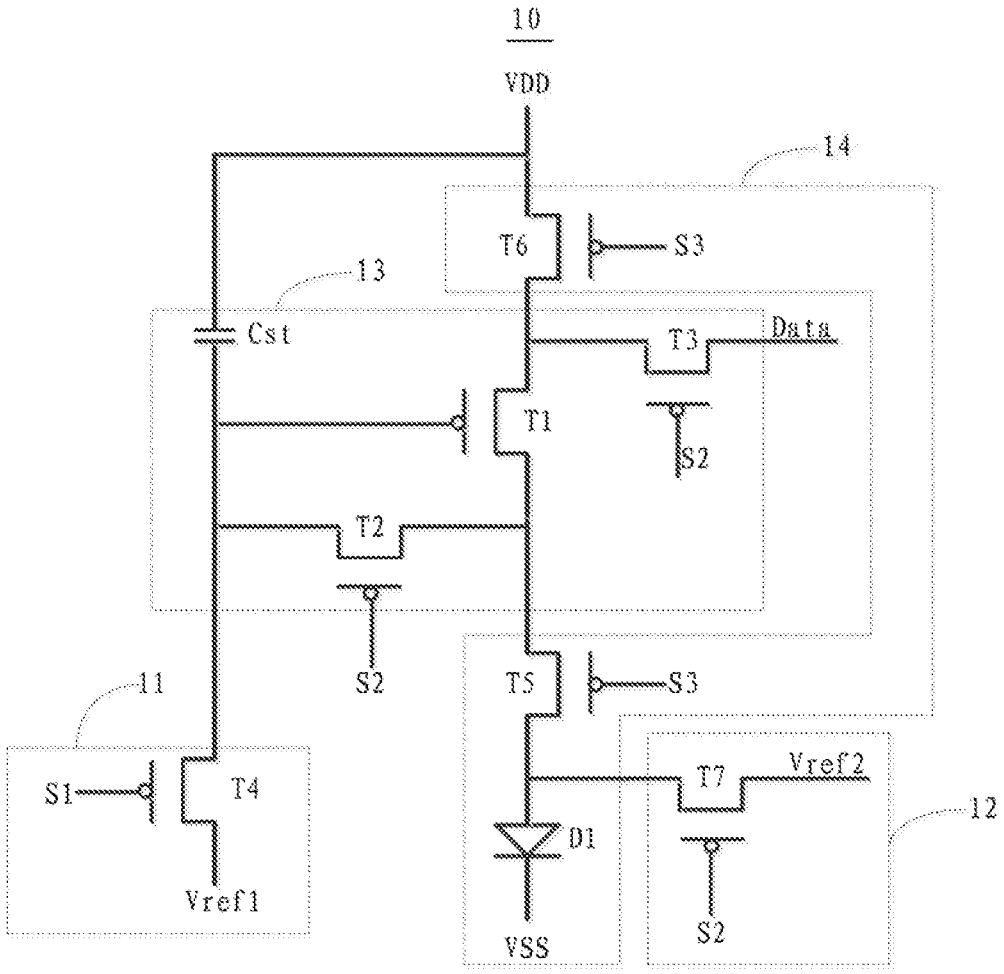
FIG. 3 is a circuit diagram of the pixel driving circuit shown in FIG. 2.

Referring to FIG. 3, a circuit diagram of the pixel driving circuit shown in FIG. 2 is depicted. As shown in FIG. 3, the compensation circuit 13 may include a first thin film transistor T1, a second thin film transistor T2, a third thin film transistor T3, and a storage capacitor Cst. The first reset circuit 11 may include a fourth thin film transistor T4; the light emitting circuit 14 may include a fifth thin film transistor T5, a sixth thin film transistor T6, and a light emitting element D1. The second reset circuit 12 may include a seventh thin film transistor T7.

In some embodiments, a gate electrode of the first thin film transistor T1 may be connected to each of one end of the storage capacitor Cst, a drain electrode of the second thin film transistor T2, and a drain electrode of the fourth thin film transistor T4 in the first reset circuit 11. A drain electrode of the first thin film transistor T1 may be connected to each of a drain electrode of the fifth thin film transistor T5 and a source electrode of the second thin film transistor T2 in the light emitting circuit 14. A source electrode of the first thin film transistor T1 may be connected to each of a source electrode of the sixth thin film transistor T6 and the drain electrode of the thin film transistor T3 in the light emitting circuit 14. A gate electrode each of the second thin film transistor T2 the thin film transistor T3 may receive the second control signal S2. A source electrode of the third thin film transistor T3 may receive the data signal Data, and a other end of the storage capacitor Cst may be connected to a first voltage VDD.

A gate electrode of the fourth thin film transistor T4 may receive the first control signal S1, a source electrode of the fourth thin film transistor T4 may be connected to the first reset voltage Vref1, and the drain electrode of the fourth thin film transistor T4 may be connected to a drain electrode of the second thin film transistor T2 in the compensation circuit 13.

A gate electrode of the fifth thin film transistor T5 may receive the third control signal S3, a drain electrode of the fifth thin film transistor T5 may be connected to the drain electrode of the first thin film transistor T1, and a source electrode of the fifth thin film transistor T5 may be connected to each of an anode electrode of the light emitting element D1 and the drain electrode of the seventh thin film transistor T7 in the second reset circuit 12. A gate electrode of the sixth thin film transistor T6 may receive the third control signal S3, a drain electrode of the sixth thin film transistor T6 may be connected to a first voltage VDD, and a source electrode of the sixth thin film transistor T6 may be connected to the source electrode of the first thin film transistor T1. A cathode electrode of the light emitting element D1 may be connected to a second voltage VSS. In some embodiments, the light emitting device D1 may be an organic light emitting diode.

A gate electrode of the seventh thin film transistor T7 may receive the second control signal S2, a source electrode of the seventh thin film transistor T7 may be connected to the second reset voltage Vref2, and a drain electrode of the seventh thin film transistor T7 may be connected to the source electrode of the fifth thin film transistor T5 in the light emitting circuit 14.

In this embodiment, the first voltage VDD may be a high level, and each of the second voltage VSS, the first reset voltage Vref1, and the second reset voltage Vref2 may be a low level.

In this embodiment, the first thin film transistor T1 may be a driving transistor, and the other thin film transistors may be switching transistors. In some embodiments, the thin film transistors may be all the P-type thin film transistors, that is, when the control signal is at a low level, the corresponding thin film transistors may be turned on. Of course, in the actual circuit design, the thin film transistors applied in the present disclosure can also be the N-type thin film transistors or a mixed manner of N-type thin film transistors and P-type thin film transistors. The functions of the source electrode and the drain electrode may be interchangeable when the thin film transistors are used as switching transistors, while there is no specific limitation.

Figure 4:
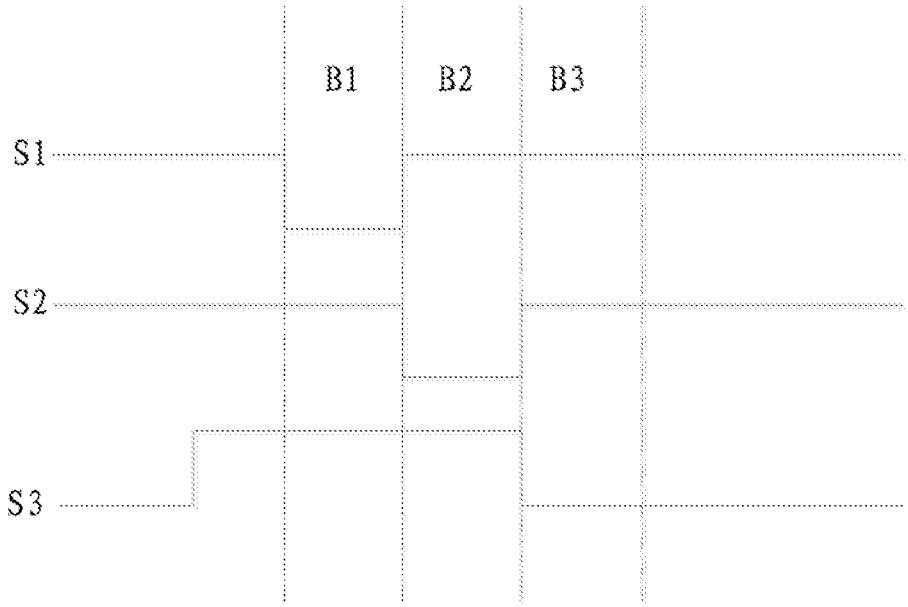
FIG. 4 is a timing diagram of the control signals of the pixel driving circuit shown in FIG. 3.

Referring to FIG. 4, a timing diagram of the control signals of the pixel driving circuit shown in FIG. 3 is depicted. As shown in FIG. 4, the working process of the pixel driving circuit 10 may be divided into three phases concluding a first working phase B1, a second working phase B2, and a third working phase B3.

The first working phase B1 may be a reset phase of the compensation circuit 13. Specifically, the first working phase B1 may be a reset phase of the gate electrode of the thin film transistor T1 in the compensation circuit 13. In the first working phase B1, the first control signal S1 may be valid while the second control signal S2 and the third control signal S3 may be invalid. In other words, the first control signal S1 may be set to a low level, and the second control signal S2 and the third control signal S3 may be set to a high level. At this time, when the fourth thin film transistor T4 is turned on, the first reset voltage Vref1 received from the source electrode of the fourth thin film transistor T4 may be output through the drain electrode of the fourth thin film transistor T4, while the gate electrode of the first thin film transistor T1 is connected to the drain electrode of the fourth thin film transistor T4, hence the gate electrode of the first thin film transistor T1 may be reset to the first reset voltage Vref1.

The second operation phase B2 may be a phase of data writing, threshold voltage compensation, and lighting circuit resetting. In the second working phase B2, the second control signal S2 may be valid while the first control signal S1 and the third control signal S3 may be invalid. In other words, the second control signal S2 may be set to a low level, and the first control signal S1 and the third control signal S3 may be set to a high level. At this time, when the second thin film transistor T2 is turned on, the gate electrode and the drain electrode of the first thin film transistor T1 may be shorted to form a diode connection structure. When the third thin film transistor T3 is turned on, the data signal Data received from the source electrode of the third thin film transistor T3 may be written into the gate electrode of the first thin film transistor T1 through the drain electrode of the second thin film transistor T2, and the gate electrode of the first thin film transistor T1 may be charged close to Vdata−|Vth| through the diode connect structure of the first thin film transistor T1. In which, Vth may be the threshold voltage of the first thin film transistor T1, and Vdata may be the voltage of the data signal.

At the same time, when the seventh thin film transistor T7 is turned on, the second reset voltage Vref1 received from the source electrode of the seventh thin film transistor T7 may be outputted through the drain electrode of the seventh thin film transistor T7, while the anode of the light emitting element D1 is connected to the drain electrode of the seventh thin film transistor T7, hence the anode of the light emitting element D1 may be reset to the second reset voltage Vref2.

The third working phase B3 may be a lighting phase. In the third working phase B3, the third control signal S3 may be valid while the first control signal S1 and the second control signal S2 may be invalid. In other words, in the third operation phase B3, the third control signal S3 may be set to a low level, and the first control signal S1 and the second control signal S2 may be set to a high level. When the fifth thin film transistor T5 and the sixth thin film transistor T6 are turned on, the driving current passing through the light emitting element D1 may meet the following formula:

$$I_{OLED} \approx k(VDD-(V\text{data}-|Vth|)-|Vth|)^2 \approx k(VDD-V\text{data})^2;$$

in which, $I_{OLED}$ may be the driving current, VDD may be the first voltage, Vdata may be the voltage of the data signal Data, and K may be the current amplification factor of the thin film transistor T1.

It can be seen from the above-mentioned formula that the driving current $I_{OLED}$ may be substantially independent of a threshold voltage Vth of the first thin film transistor T1, hence the problem of the shift of the threshold voltage Vth of the first thin film transistor T1 can be eliminated, which may cause poor display of the screen.

In addition, in the present disclosure, the reset voltage of the gate electrode of the first thin film transistor T1 may be set to the first reset voltage Vref1, and the reset voltage of the anode of the light emitting element D1 may be set to the second reset voltage Vref2, in which condition, the first reset voltage Vref1 and the second reset voltage Vref2 may be set separately to reduce the brightness of the black screen, thereby increasing the contrast of the display panel.

Specifically, for a high-resolution display panel, since the second control signal S2 may be at a low level for a short time, the voltage of the gate electrode of the first thin film transistor T1 can only approach while cannot reach Vdata−|Vth|. As the first reset voltage Vref1 rising, the voltage of the gate electrode of the first thin film transistor T1 increases accordingly while the second control signal S2 changes to a high level. Therefore, when the black screen is displayed, the first reset voltage Vref1 can be set to a higher voltage so as to reduce the driving current and the brightness of the black screen, thereby achieving the purpose of increasing the contrast of the display panel.

At the same time, the second reset voltage Vref2 may be set to a lower voltage, so that the light emitting element D1 may do not easily be charged to a turn-on voltage and emit light, and the brightness of the black screen may be 0, which can greatly improve the contrast.

In summary, the second reset voltage Vref2 may need to be set smaller than the second voltage VSS, and the first reset voltage Vref1 may be set according to the brightness of the black screen until the set first reset voltage Vref1 makes the brightness of the black screen reach a minimum value.

In this embodiment, the first reset voltage Vref1 and the second reset voltage Vref2 may be different. In some embodiments, the first reset voltage Vref1 may be greater than the second reset voltage Vref2.

Figure 5:
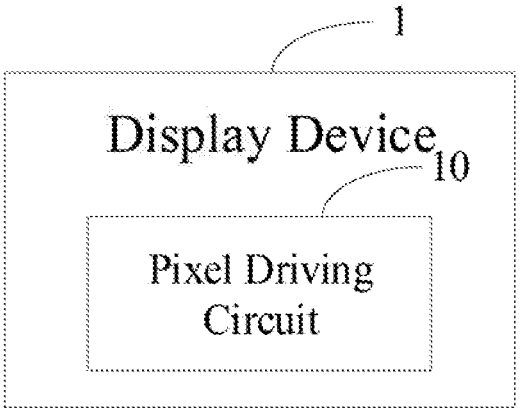
FIG. 5 is a schematic diagram of the structure of a display device according to an embodiment of the present disclosure.

Referring to FIG. 5, a schematic diagram of the structure of a display device according to an embodiment of the present disclosure is depicted. As shown in FIG. 5, a display device 1 may include the above-mentioned pixel driving circuit 10.

The beneficial effects of the present disclosure may be as follows. The pixel driving circuit and the display device of the present disclosure may include a first reset circuit, a second reset circuit, a compensation circuit, and a light emitting circuit. The first reset circuit may be configured to receive a first control signal and transmit a first reset voltage to the compensation circuit to reset the compensation circuit according to the first control signal. The second reset circuit may be configured to receive a second control signal and transmit a second reset voltage to the light emitting circuit to reset the light emitting circuit according to the second control signal. The compensation circuit may be configured to receive the second control signal, and write a data signal and perform a threshold voltage compensation according to the second control signal. The light emitting circuit may be configured to receive a third control signal and emit light according to the third control signal. Through the above-mentioned manner, the present disclosure may be capable of realizing the compensation of the threshold voltage and adjusting the contrast of the displayed black screen by adjusting the first reset voltage and the second reset voltage, thereby improving the display characteristics of the display device.

The above-mentioned embodiments merely represent several examples of the present disclosure, and the description thereof is more specific and detailed, but it should not be considered as limitations to the scope of the present disclosure. It should be noted that, for those skilled in the art, various variations and improvements may be made without departing from the concept of the present disclosure and are all within the protection scope of the present disclosure. Therefore, the protection scope of the present disclosure shall be subject to the appended claims.

What is claimed is:

1. A pixel driving circuit, comprising a first reset circuit, a second reset circuit, a compensation circuit, and a light emitting circuit;

the first reset circuit is configured to receive a first control signal and transmit a first reset voltage to the compensation circuit to reset the compensation circuit according to the first control signal;

the second reset circuit is configured to receive a second control signal and transmit a second reset voltage to the light emitting circuit to reset the light emitting circuit according to the second control signal;

the compensation circuit is configured to receive the second control signal, and write a data signal and perform a threshold voltage compensation according to the second control signal;

the light emitting circuit is configured to receive a third control signal and emit light according to the third control signal;

wherein, the first reset circuit comprises a fourth thin film transistor; a gate electrode of the fourth thin film transistor receives the first control signal, a source electrode of the fourth thin film transistor is connected to the first reset voltage, and a drain electrode of the fourth thin film transistor is connected to the compensation circuit;

wherein, the second reset circuit comprises a seventh thin film transistor; a gate electrode of the seventh thin film transistor receives the second control signal, a source electrode of the seventh thin film transistor is connected to the second reset voltage, and a drain electrode of the seventh thin film transistor is connected to the light emitting circuit;

wherein, the compensation circuit comprises a first thin film transistor, a second thin film transistor, a third thin film transistor, and a storage capacitor; a gate electrode of the first thin film transistor is connected to each of one end of the storage capacitor, a drain electrode of the second thin film transistor, and the first reset circuit; a drain electrode of the first thin film transistor is connected to each of the light emitting circuit and a source electrode of the second thin film transistor; a source electrode of the first thin film transistor is connected to each of the light emitting circuit and a drain electrode of the third thin film transistor; a gate electrode of the second thin film transistor and a gate electrode of the third thin film transistor receive the second control signal; a source electrode of the third thin film transistor receives the data signal; and another end of the storage capacitor is connected to a first voltage;

wherein, the light emitting circuit comprises a fifth thin film transistor, a sixth thin film transistor, and a light emitting element; a gate electrode of the fifth thin film transistor receives the third control signal, a drain electrode of the fifth thin film transistor is connected to the drain electrode of the first thin film transistor, and a source electrode of the fifth thin film transistor is connected to each of an anode electrode of the light emitting element and a drain electrode of the seventh thin film transistor; a gate electrode of the sixth thin film transistor receives the third control signal, a drain electrode of the sixth thin film transistor is connected to the first voltage, a source electrode of the sixth thin film transistor is connected to the source electrode of the first thin film transistor; and a cathode electrode of the light emitting element is connected to a second voltage;

wherein, the first voltage is a high level, and each of the second voltage, the first reset voltage, and the second reset voltage is a low level;

wherein, the working process of the circuit is divided into a first working phase, a second working phase, and a third working phase; in the first working phase, the first control signal is valid while the second control signal and the third control signal are invalid; in the second working phase, the second control signal is valid while the first control signal and the third control signal are invalid; in the third working phase, the third control signal is valid while the first control signal and the second control signal are invalid;

wherein, the first reset voltage is adjusted according to the brightness of a black screen until the first reset voltage makes the brightness of the black screen reach a minimum value.

2. The pixel driving circuit of claim 1, wherein the second reset voltage is smaller than the second voltage.

3. A pixel driving circuit, wherein the circuit comprises a first reset circuit, a second reset circuit, a compensation circuit, and a light emitting circuit;

the first reset circuit is configured to receive a first control signal and transmit a first reset voltage to the compensation circuit to reset the compensation circuit according to the first control signal;

the second reset circuit is configured to receive a second control signal and transmit a second reset voltage to the light emitting circuit to reset the light emitting circuit according to the second control signal;

the compensation circuit is configured to receive the second control signal, and write a data signal and perform a threshold voltage compensation according to the second control signal;

the light emitting circuit is configured to receive a third control signal and emit light according to the third control signal;

wherein, the first reset voltage is adjusted according to the brightness of a black screen until the first reset voltage makes the brightness of the black screen reach a minimum value.

4. The pixel driving circuit of claim 3, wherein, the first reset circuit comprises a fourth thin film transistor;

a gate electrode of the fourth thin film transistor receives the first control signal, a source electrode of the fourth thin film transistor is connected to the first reset voltage, and a drain electrode of the fourth thin film transistor is connected to the compensation circuit.

5. The pixel driving circuit of claim 4, wherein, the second reset circuit comprises a seventh thin film transistor;

a gate electrode of the seventh thin film transistor receives the second control signal; a source electrode of the seventh thin film transistor is connected to the second reset voltage, and a drain electrode of the seventh thin film transistor is connected to the light emitting circuit.

6. The pixel driving circuit of claim 5, wherein, the compensation circuit comprises a first thin film transistor, a second thin film transistor, a third thin film transistor, and a storage capacitor;

a gate electrode of the first thin film transistor is connected to each of one end of the storage capacitor, a drain electrode of the second thin film transistor, and the first reset circuit; a drain electrode of the first thin film transistor is connected to each of the light emitting circuit and a source electrode of the second thin film transistor, and a source electrode of the first thin film transistor is connected to each of the light emitting circuit and a drain electrode of the third thin film transistor;

a gate electrode each of the second thin film transistor and the third thin film transistor receives the second control signal;

a source electrode of the third thin film transistor receives the data signal; and another end of the storage capacitor is connected to a first voltage.

7. The circuit of claim 6, wherein, the light emitting circuit comprises a fifth thin film transistor, a sixth thin film transistor, and a light emitting element;

a gate electrode of the fifth thin film transistor receives the third control signal, and a drain electrode of the fifth thin film transistor is connected to the drain electrode of the first thin film transistor; a source electrode of the fifth thin film transistor is connected to each of an anode electrode of the light emitting element and the drain electrode of the seventh thin film transistor;

a gate electrode of the sixth thin film transistor receives the third control signal, a drain electrode of the sixth thin film transistor is connected to the first voltage, and a source electrode of the sixth thin film transistor is connected to the source electrode of the first thin film transistor; and a cathode electrode of the light emitting element is connected to a second voltage.

8. The pixel driving circuit of claim 7, wherein, the first voltage is a high level, and each of the second voltage, the first reset voltage, and the second reset voltage is a low level.

9. The pixel driving circuit of claim 8, wherein the second reset voltage is smaller than the second voltage.

10. The pixel driving circuit of claim 7, wherein, the working process of the circuit is divided into a first working phase, a second working phase, and a third working phase;

in the first working phase, the first control signal is valid while the second control signal and the third control signal are invalid;

in the second working phase, the second control signal is valid while the first control signal and the third control signal are invalid;

in the third working phase, the third control signal is valid while the first control signal and the second control signal are invalid.

11. The pixel driving circuit of claim 10, wherein if the thin film transistors in the circuit are P-type thin film transistors:

the first control signal, the second control signal, and the third control signal are valid, when the first control signal, the second control signal, and the third control signal are at a low level; and the first control signal, the second control signal, and the third control signal are invalid, when the first control signal, the second control signal, and the third control signal are at a high level.

12. A display device, comprising a pixel driving circuit, wherein the circuit comprises a first reset circuit, a second reset circuit, a compensation circuit, and a light emitting circuit;

the first reset circuit is configured to receive a first control signal and transmit a first reset voltage to the compensation circuit to reset the compensation circuit according to the first control signal;

the second reset circuit is configured to receive a second control signal and transmit a second reset voltage to the light emitting circuit to reset the light emitting circuit according to the second control signal;

the compensation circuit is configured to receive the second control signal, and write a data signal and perform a threshold voltage compensation according to the second control signal;

the light emitting circuit is configured to receive a third control signal and emit light according to the third control signal;

wherein, the first reset voltage is adjusted according to the brightness of a black screen until the first reset voltage makes the brightness of the black screen reach a minimum value.

13. The display device of claim 12, wherein, the first reset circuit comprises a fourth thin film transistor;

a gate electrode of the fourth thin film transistor receives the first control signal, a source electrode of the fourth thin film transistor is connected to the first reset voltage, and a drain electrode of the fourth thin film transistor is connected to the compensation circuit.

14. The display device of claim 13, wherein, the second reset circuit comprises a seventh thin film transistor;

a gate electrode of the seventh thin film transistor receives the second control signal; a source electrode of the seventh thin film transistor is connected to the second reset voltage, and a drain electrode of the seventh thin film transistor is connected to the light emitting circuit.

15. The display device of claim 14, wherein, the compensation circuit comprises a first thin film transistor, a second thin film transistor, a third thin film transistor, and a storage capacitor;

a gate electrode of the first thin film transistor is connected to each of one end of the storage capacitor, a drain electrode of the second thin film transistor, and the first reset circuit; a drain electrode of the first thin film transistor is connected to each of the light emitting circuit and a source electrode of the second thin film transistor, and a source electrode of the first thin film transistor is connected to each of the light emitting circuit and a drain electrode of the third thin film transistor;

a gate electrode each of the second thin film transistor and the third thin film transistor receives the second control signal;

a source electrode of the third thin film transistor receives the data signal; and a other end of the storage capacitor is connected to a first voltage.

16. The display device of claim 15, wherein, the light emitting circuit comprises a fifth thin film transistor, a sixth thin film transistor, and a light emitting element;

a gate electrode of the fifth thin film transistor receives the third control signal, and a drain electrode of the fifth thin film transistor is connected to the drain electrode of the first thin film transistor; a source electrode of the fifth thin film transistor is connected to each of an anode electrode of the light emitting element and the drain electrode of the seventh thin film transistor;

a gate electrode of the sixth thin film transistor receives the third control signal, a drain electrode of the sixth thin film transistor is connected to the first voltage, and a source electrode of the sixth thin film transistor is connected to the source electrode of the first thin film transistor; and a cathode electrode of the light emitting element is connected to a second voltage.

17. The display device of claim 16, wherein, the first voltage is a high level, and each of the second voltage, the first reset voltage, and the second reset voltage is a low level.

18. The display device of claim 17, wherein the second reset voltage is smaller than the second voltage.

19. The display device of claim 16, wherein, the working process of the circuit is divided into a first working phase, a second working phase, and a third working phase;

in the first working phase, the first control signal is valid while the second control signal and the third control signal are invalid;

in the second working phase, the second control signal is valid while the first control signal and the third control signal are invalid;

in the third working phase, the third control signal is valid while the first control signal and the second control signal are invalid.

20. The display device of claim 19, wherein when the thin film transistors in the circuit are P-type thin film transistors:

the first control signal, the second control signal, and the third control signal are valid, when the first control signal, the second control signal, and the third control signal are at a low level; and the first control signal, the second control signal, and the third control signal are invalid, when the first control signal, the second control signal, and the third control signal are at a high level.

* * * * *